US008317198B2

(12) United States Patent
Noyes

(10) Patent No.: US 8,317,198 B2
(45) Date of Patent: Nov. 27, 2012

(54) METHOD OF PLAYING A CARD GAME

(76) Inventor: Frederick D. Noyes, Trenton, ME (US)

( * ) Notice: Subject to any disclaimer, the term of this patent is extended or adjusted under 35 U.S.C. 154(b) by 1587 days.

(21) Appl. No.: 11/206,598

(22) Filed: Aug. 18, 2005

(65) Prior Publication Data

US 2007/0040332 A1 Feb. 22, 2007

(51) Int. Cl.
*A63F 1/00* (2006.01)

(52) U.S. Cl. ..... 273/292

(58) Field of Classification Search ..... 273/292, 273/274, 309; 463/13
See application file for complete search history.

(56) References Cited

U.S. PATENT DOCUMENTS 5,382,025 A 1/1995 Sklansky et al.
5,868,392 A 2/1999 Kraft
6,102,402 A * 8/2000 Scott et al. ..... 273/292
6,325,375 B1 12/2001 Potter et al.
6,896,265 B1 5/2005 Schlumbrecht
2002/0103018 A1 * 8/2002 Rommerdahl et al. ..... 463/16
2005/0285340 A1 * 12/2005 Boylan et al. ..... 273/292
2006/0001216 A1 * 1/2006 Strong et al. ..... 273/292

* cited by examiner

*Primary Examiner* — Michael Dennis

(74) *Attorney, Agent, or Firm* — Preti Flaherty Beliveau & Pachios LLP

(57) ABSTRACT

A method of playing a card game adds a "showdown" aspect to a conventional game such as Texas Hold 'Em or the like. Generally, a round of the conventional game is played out in the usual fashion. Then, the winning hand from this play is pitted against a specially dealt showdown hand. A jackpot is awarded to the player holding the winning hand if the showdown hand beats the winning hand based on a pre-established ranking of hands.

17 Claims, 2 Drawing Sheets

METHOD OF PLAYING A CARD GAME

BACKGROUND OF THE INVENTION

This invention relates generally to card games and more particularly to a card game that is a variation of standard games such as Texas Hold 'Em.

Texas Hold 'Em is a well known form of poker that has become extremely popular in recent years. In this game, each player is dealt two cards face down. These cards are known as the "hole" cards. After a round of betting, three community cards, known as the "flop," are dealt face up. Another round of betting follows, and then a fourth community card, called the "turn" or "fourth street," is dealt face up. Following further betting, a fifth and final community card, called the "river" or "fifth street," is dealt face up. Then, a final round of betting occurs. Players may fold at any time during the four rounds of betting. After all cards are dealt, each remaining player uses his or her hole cards in combination with a number of the community cards to make the best five-card hand possible. The remaining player having the highest ranking hand is declared the winner and is awarded the pot.

While very popular, Texas Hold 'Em only offers players the opportunity to win one pot during each round of play. Accordingly, it would be desirable to have a version of Texas Hold 'Em and similar games in which players were able to compete for more than one pot.

SUMMARY OF THE INVENTION

The above-mentioned need is met by the present invention, which provides a method of playing a card game in which a "showdown" aspect is added to a conventional game such as Texas Hold 'Em or the like. Generally, a round of the conventional game is played out in the usual fashion. Then, the winning hand from this play is pitted against a specially dealt showdown hand. A jackpot is awarded to the player holding the winning hand if the showdown hand beats the winning hand based on a pre-established ranking of hands.

The present invention and its advantages over the prior art will be more readily understood upon reading the following detailed description and the appended claims with reference to the accompanying drawings.

DESCRIPTION OF THE DRAWINGS

The subject matter that is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

The present invention generally relates to providing a unique twist to playing a conventional card game, such as Texas Hold 'Em. In one embodiment, a "showdown" aspect is added to the conventional play so that some hands or rounds of play will include two components: a basic play component and a showdown component. The basic play component comprises the normal play of the conventional game that is the core of the new method. Therefore, the players participate in conventional play of the core game during the basic play component. In the showdown component, one player (or more than one player in some instances) competes against a specially dealt showdown hand in an attempt to win a separate jackpot. As will be understood from the following description, the showdown component will not necessarily occur in every round.

Figure 1:
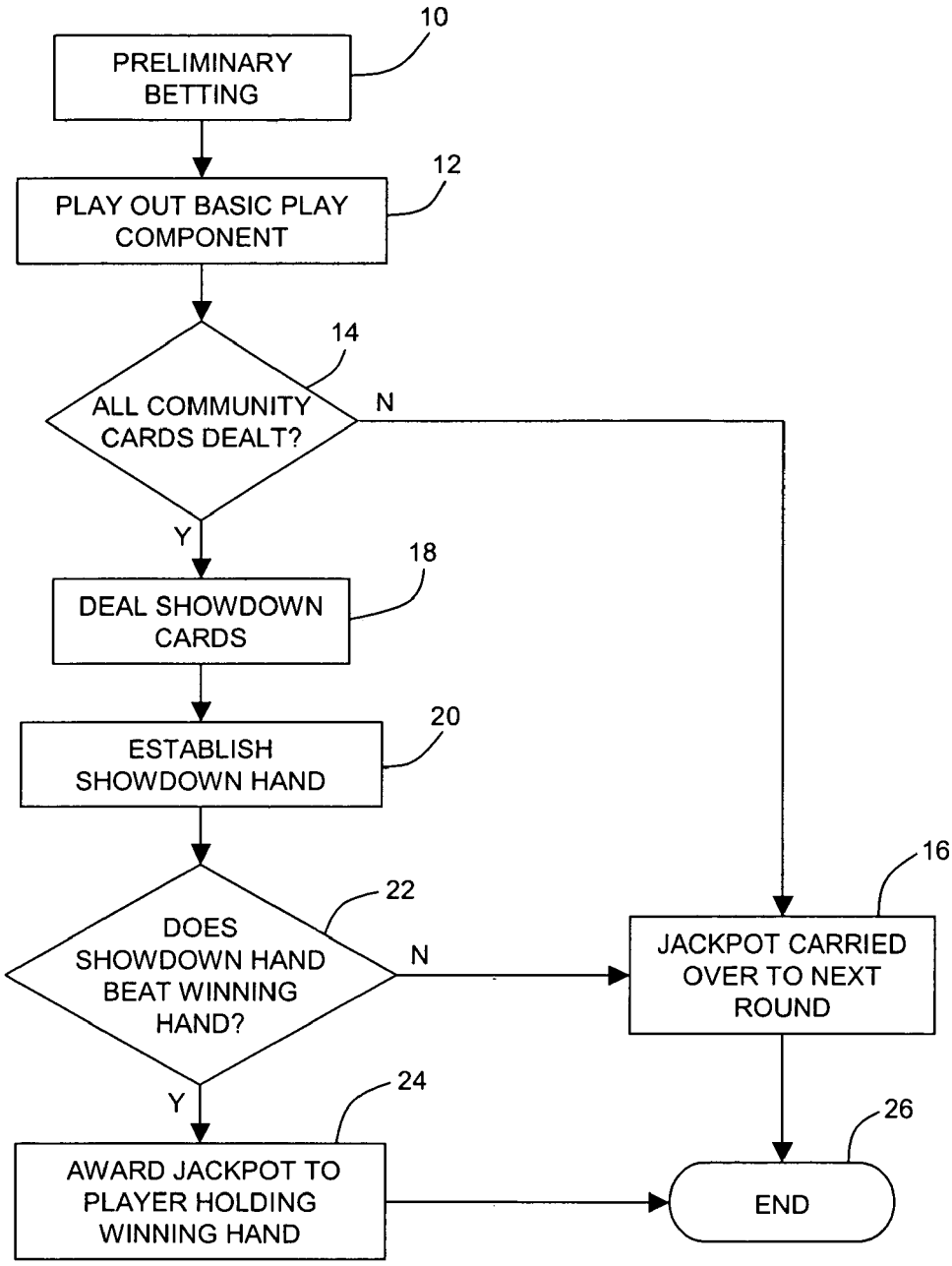
FIG. 1 is a flow chart showing the process of a round of play of one embodiment of a card game.

FIG. 1 illustrates one embodiment of a method of playing a card game. By way of example, the core game in this embodiment is Texas Hold 'Em. However, it should be noted that the present invention is applicable to many other card games in addition to Texas Hold 'Em. A round of play begins, at block 10, with preliminary betting that occurs before any cards are dealt. This preliminary betting can include each player placing an initial or "ante" bet of a predetermined, equal amount into a first pot. This first pot, which is referred to herein as the base pot, is the pot the players will be competing for in the basic play component, i.e., in the normal course of Texas Hold 'Em play. This base pot will accumulate during the round of play in normal fashion. The players are also given the opportunity of placing a side bet into a second pot, referred to herein as the jackpot. The amount of the side bet will be a predetermined, equal amount, which can be but is not necessarily the same as the ante bet. An alternative to separate ante and side bets would be to use the ante bet as the side bet. In other words, the players would place their ante bets into the jackpot instead of the base pot.

In one embodiment, the players participating in the game will have the option of placing the side bet into the jackpot or not. Players electing not to place the side bet would then be able to participate in the basic play component but would not be eligible to participate in the showdown component and try to win the jackpot. Another embodiment would be to make participation in the showdown component mandatory. That is, every player wishing to participate in the game will be required to place the side bet and would thus be participating in both components of play. New entrants into an ongoing game must place an amount into the jackpot equal to what the other players have already contributed into a current jackpot. In either embodiment, the jackpot will not necessarily be awarded during every round and can carry over to subsequent rounds.

Figure 2:
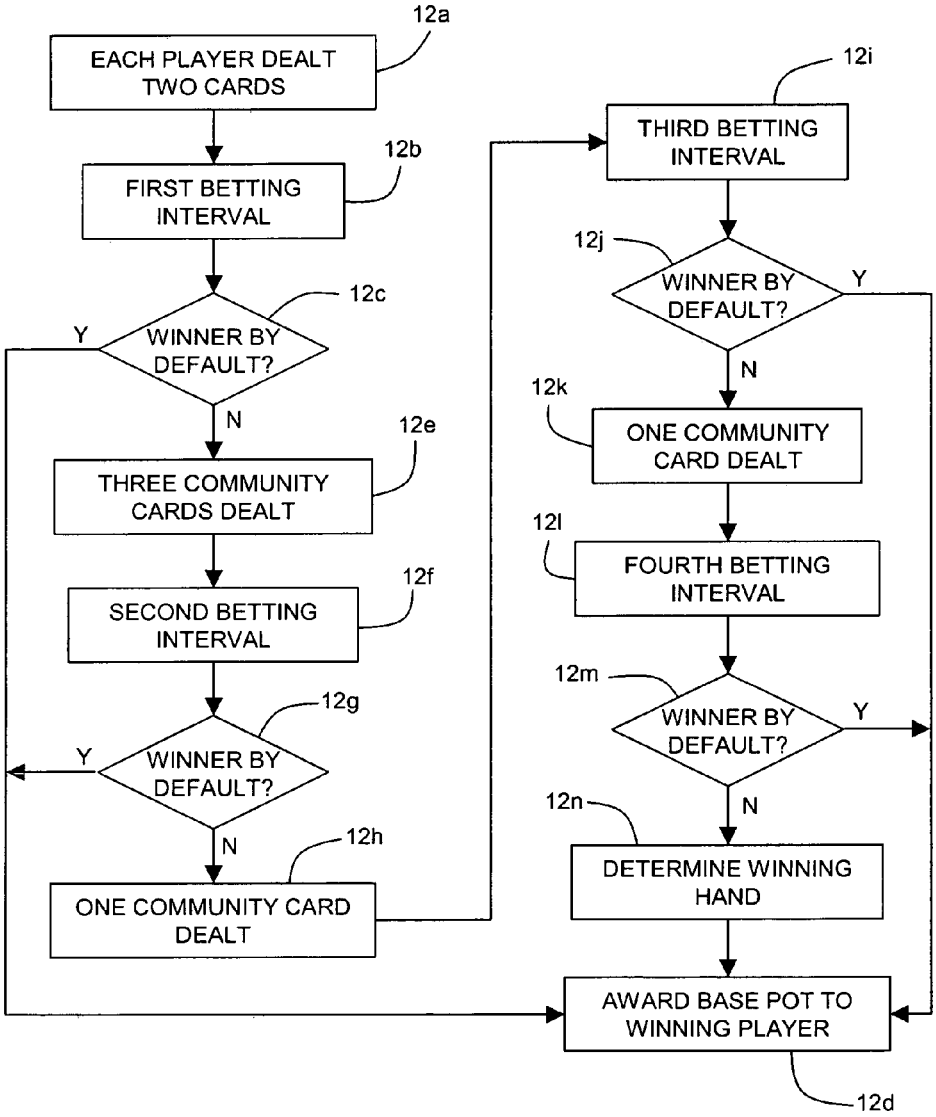
FIG. 2 is a flow chart showing the process for playing out the basic play component of the card game of FIG. 1.

After the preliminary betting is completed, the basic play component of the round is played out according to pre-established rules as shown, at block 12. One preferred core game for playing out the basic play component is traditional Texas Hold 'Em play. However, as mentioned previously, it should be noted that the present invention is applicable to many other card games. Referring to FIG. 2, the specifics of playing out the basic play component are described. In this case, each player is first dealt two initial cards (sometimes referred to as the player's "hole" cards), at block 12*a*. These initial cards are dealt face down so that the players do not know what cards the other players hold. After each player has seen his or her hole cards, the players engage in a first betting interval, at block 12*b*. Betting in the present invention preferably occurs in the normal fashion of Texas Hold 'Em and many other poker games. Namely, during a betting interval, players place bets into the base pot in a predetermined order. The first player decides whether to bet, pass or fold. Subsequent players act accordingly based on what prior players have done and on how they want to play their hand. For example, if the first player places a bet, the next player must call the bet (i.e., bet an amount equal to the first player's bet), call and raise the bet, or fold. As is well known, "folding" refers to a player electing to retire from the current round of play, in which event the player forfeits his or her contributions to the current base pot.

If the first player has passed or folded, the second player would then have the option to bet, pass or fold. The betting interval continues until all players are either "in" (having called all bets) or out due to folding their hand.

The next step, at block 12*c*, is to determine whether there is a winner by default at the conclusion of the first betting interval. A winner by default refers to the situation where a player wins because all other players fold during the betting interval. In other words, a player makes a bet and the other players all fold rather than matching the bet. In this case, the winning player typically does not show his or her cards. Because the winning player does not reveal his or her cards, the folding players do not learn whether the winning player was bluffing or not. If there is a winner by default as a result of the first betting interval, than the winning player is awarded the base pot as shown at block 12*d*. If there is not a winner by default, then play continues at block 12*e* wherein the dealer deals the first three community cards. These cards, which are commonly referred to as the "flop," are dealt face up and can be used by all players in establishing their hands.

After the flop is dealt, the players engage in a second betting interval, at block 12*f*. A determination is then made as to whether there is a winner by default at the conclusion of the second betting interval, at block 12*g*. If there is a winner by default as a result of the second betting interval, than the winning player is awarded the base pot as shown at block 12*d*. If there is not a winner by default at this point, then play continues at block 12*h* wherein the dealer deals another community card, which is commonly referred to as the "turn." The turn is also dealt face up and can be used by all players in establishing their hands.

A third betting interval follows the turn being dealt, as shown at block 12*i*, and then a determination is made as to whether there was a winner by default from the third betting interval, at block 12*j*. If there is a winner by default as a result of the third betting interval, then the winning player is awarded the base pot as shown at block 12*d*. If there is not a winner by default, then play continues at block 12*k* wherein the dealer deals one last community card, which is commonly referred to as the "river." The river is also dealt face up and can be used by all players in establishing their hands.

After the river card is dealt, a fourth and final betting interval is commenced, at block 12*l*. Upon completion of the fourth betting interval, a determination is made as to whether there is a winner by default resulting from the fourth betting interval, at block 12*m*. If there is a winner by default as a result of the fourth betting interval, than the winning player is awarded the base pot, as shown at block 12*d*. If there is not a winner by default at block 12*m*, then this means that there are two or more players still competing for the base pot. In this case, the next step, at block 12*n*, is to determine which one of the remaining players holds the winning hand. This is done by having the remaining players reveal their hole cards, which in turn reveals their five-card hands that are established from any combination of the community cards and their hole cards. The five-card hands of the remaining players are then compared so that the winning hand can be determined. The winning hand is determined based on a pre-established ranking of hands, which is preferably the standard poker ranking (i.e., royal flush, straight flush, four of a kind, full house, flush, straight, three of a kind, two pair, one pair, high card). The player holding the winning hand is then awarded the base pot, at block 12*d*.

In some instances, two or more players will hold equal hands based on the pre-established ranking of hands. When this occurs, a tie will be declared and the tying players will split the base pot. Because of this possibility of tying hands, it is noted that the phrases "the player holding the winning hand" and "the player who wins the basic play component," as used herein, are intended to include all players that hold a winning hand in a round. The basic play component of a round concludes with the awarding of the base pot, either by default or through establishing the best hand. It should be noted that the foregoing describes just one possible mode of playing the basic play component and that many alternatives are possible. For instance, the basic play component could include different combinations of hole and community cards, such as three hole cards and four community cards.

Referring again to FIG. 1, after the basic play component is concluded, the method continues at block 14 by determining whether all of the community cards (five in the illustrated example) were dealt during the basic play component. (All of the community cards are not dealt if a player wins by default during one of the early betting intervals.) If all of the community cards were not dealt, then the jackpot is not awarded and is carried over to the next round, as shown at block 16 and the showdown component is not carried out. However, if all of the community cards were dealt, then the showdown component of the game is carried out. The showdown component begins at block 18 with the dealer dealing a number of additional or showdown cards. The number of showdown cards dealt is equal to the number of hole cards dealt to each player, which is typically two. These are dealt face up so that all players can see them. Optionally, the dealer may "bury" one or more cards prior to dealing the showdown cards. Burying cards refers the practice of removing cards from the top of the remaining deck and setting them aside without being revealed. This practice is designed to prevent cheating.

Next, at block 20, the showdown cards are used with the community cards dealt during the basic play component to establish the best possible five-card hand, referred to herein as the showdown hand. (The showdown hand relying on the community cards is why the showdown component is not played out if all of the community cards are not dealt during the basic play component.) The showdown hand is compared to the winning hand to determine whether the showdown hand beats the winning hand, based on the pre-established ranking of hands, at block 22. If the showdown hand does not beat the winning hand, then the jackpot is not awarded and is carried over to the next round, as shown at block 16. If the showdown hand does beat the winning hand, then the jackpot is awarded to the player holding the winning hand, at block 24. Because multiple players are involved, the odds are such that the showdown hand will not beat the winning hand a majority of the time.

In the case where there are tied winning hands from the basic play component, and the tied winning hands are subsequently beaten by the showdown hand, then the players holding the tied winning hands will split the jackpot. In the case where the winning and showdown hands are tied, then the player holding the winning hand will preferably be awarded one half of the jackpot. Alternatives for a handling a tie between the winning and showdown hands include awarding the entire jackpot to the player holding the winning hand or carrying over the jackpot to the next round.

The round of play is concluded once the jackpot is either awarded or carried over, as shown at block 26. At this point, play will either proceed to another round or be discontinued, although it is generally preferable to not discontinue play when the jackpot has been carried over. When the jackpot is carried over to the next round, new side bets will be placed therein such that the jackpot will accumulate from round to round and thus has the prospect of becoming quite large. In light of this, an optional feature of the game is to place a limit on how many rounds the jackpot can be carried over. For instance, it could be decided that if the showdown jackpot carries over for a predetermined number (such as 5 or 10 for example) of consecutive rounds, then the next round will be an "jackpot round" in which the showdown jackpot is automatically awarded to the player who wins the basic play component. Another possible feature is that the players have the option of jointly deciding at the beginning of a round that the round will be a jackpot round. This might occur in situations where the players wish to discontinue play or are approaching a time limit and need to dispense the jackpot. In addition, in the case of the game being played at a commercial gaming facility, the dealer could have the option of declaring at the beginning of a round that the round will be a jackpot round.

In some rounds, a player may win the basic play component by default after all community cards have been dealt. This happens when all other players fold during the fourth betting interval. Because the player winning in this manner may have been bluffing, it is generally desirable to not reveal his or her hole cards so that the others players cannot learn whether or not the winning player was bluffing. However, the winning player cannot take the showdown jackpot without showing his or her cards. One approach to the showdown component of play when this situation occurs is to deal the showdown cards and give the winning player the choice of whether or not to reveal his or her cards. The winning player could elect to not show his or her cards to keep the other players from finding out if he or she was bluffing. However, if the winning player wanted to claim the jackpot, where the showdown hand beat the winning hand, he or she would have to reveal the hole cards. An alternative approach to this situation is to give the winning player the option of participating in the showdown component before the showdown cards are dealt. If the winning player elects to participate in the showdown component, he or she would reveal the hole cards, and then the showdown cards would be dealt and compared to the winning hand. If the winning player elects to not participate in the showdown component, the hole cards would not be revealed and the round would conclude at that point. Another possible approach for when this situation occurs is to not have a showdown component at all. In other words, the showdown component does not occur and the jackpot carries over whenever a player wins by default during the final betting interval.

The card game of the present invention can be played live using one or more decks of conventional playing cards or it can be played in electronic or video form via video game machines, computers and the like. The card game of the present invention can be played live in a variety of venues. For instance, the game can be played in a private setting such as a home. The game can also be played at a commercial gaming facility (referred to herein as the "house") such as a casino, cardroom or the like. In this case, the house generally supplies the facilities and equipment for play and a dealer. For compensation, the house typically charges each player a fee for playing and/or takes a percentage of the pot. With respect to the showdown component, the house could take a percentage, such as 5% for example, of each jackpot. In addition to live table play, the above-described embodiments of the present invention can be implemented in electronic or computer-based versions played on electronic gaming devices or via Internet gaming applications. A number of individual hands can be simulated, electronic representations of the cards dealt to those hands can be generated, electronic bets can be placed (where permitted), and winners can be chosen according to the various criteria and playing options described above. Such electronic versions of the game can include any number of simultaneous players, particularly with simulcast or Internet play. In this case, the commercial gaming facility or house is the entity that organizes and enables the electronic play. As with live play, the house in electronic play can charge participation fees and/or take a certain percentage of the pots, including the showdown jackpot.

While specific embodiments of the present invention have been described, it will be apparent to those skilled in the art that various modifications thereto can be made without departing from the spirit and scope of the invention as defined in the appended claims.

What is claimed is:

1. A method of playing a card game, said method comprising using a computer programmed to generate electronic representations of playing cards to carry out the following steps:

playing out a basic play component of said game so as to determine at least one winning hand;

pitting said winning hand against a specially dealt showdown hand that is not used in said basic play component to determine said winning hand; and awarding a jackpot to the player holding said winning hand if said showdown hand beats said winning hand based on a pre-established ranking of hands.

2. The method of claim 1 wherein said jackpot is not awarded if said winning hand beats said showdown hand based on said pre-established ranking of hands.

3. The method of claim 1 further comprising allowing players to place one or more bets into a base pot, wherein said base pot is awarded to the player holding said winning hand.

4. The method of claim 1 wherein said basic play component is Texas Hold 'Em.

5. The method of claim 1 wherein said showdown hand includes a combination of community cards dealt during said basic play component and additional cards dealt after said basic play component.

6. A method of playing a card game, said method comprising using a computer programmed to generate electronic representations of playing cards to carry out the following steps:

allowing players to place a bet of a predetermined amount into a jackpot;

dealing a predetermined number of initial cards to each player;

dealing a number of community cards, wherein players are able to use any combination of said community cards and their initial cards to establish a hand;

determining a winning hand from amongst all of the hands;

dealing a number of additional cards;

establishing a showdown hand from said additional cards and said community cards;

comparing said winning hand to said showdown hand; and awarding said jackpot to the player holding said winning hand if said showdown hand beats said winning hand based on a pre-established ranking of hands.

7. The method of claim 6 wherein said jackpot is not awarded if said winning hand beats said showdown hand based on said pre-established ranking of hands.

8. The method of claim 6 further comprising allowing players to place one or more bets into a base pot, wherein said base pot is awarded to the player holding said winning hand.

9. The method of claim 6 wherein said additional cards are not dealt if all of said community cards have not been dealt.

10. The method of claim 9 wherein said jackpot is not awarded if said additional cards are not dealt.

11. The method of claim 6 wherein said initial cards of the player holding said winning hand must be revealed for said jackpot to be collected.

12. The method of claim 6 wherein said pre-established ranking of hands is the standard poker ranking.

13. The method of claim 6 wherein the number of additional cards dealt is equal to the number of initial cards dealt per player.

14. The method of claim 13 wherein the number of initial cards dealt per player is two.

15. The method of claim 6 wherein the number of initial cards dealt per player is two and the number of community cards dealt is five.

16. The method of claim 6 wherein said initial cards are dealt face down and said community cards and said additional cards are dealt face up.

17. The method of claim 6 wherein said game is hosted by a commercial gaming facility and said commercial gaming facility collects a predetermined percentage of each jackpot.

* * * * *